US005259466A

United States Patent [19]

Venditto et al.

[11] Patent Number: 5,259,466

[45] Date of Patent: Nov. 9, 1993

[54] METHOD AND APPARATUS FOR ORIENTING A PERFORATING STRING

[75] Inventors: James J. Venditto, Duncan; David E. McMechan, Marlow, both of Okla.; Calvin Kessler; Harold E. Peelman, both of Houston,, Tex.

[73] Assignee: Halliburton Company, Duncan, Okla.

[21] Appl. No.: 897,257

[22] Filed: Jun. 11, 1992

[51] Int. Cl.[5] ..... E21B 43/119

[52] U.S. Cl. ..... 175/4.51; 166/55.1; 166/297

[58] Field of Search ..... 175/4.51, 4.5, 4.52, 175/4.53; 166/297, 55, 55.1

[56] References Cited

U.S. PATENT DOCUMENTS

| | | | |
|---|---|---|---|
| 2,337,269 | 12/1943 | Piety | 175/4.51 |
| 2,414,997 | 1/1947 | Atkins | 285/97.3 |
| 2,476,137 | 7/1949 | Dol | 175/4.51 X |
| 3,291,208 | 12/1966 | Kenneday | 175/4.51 X |
| 3,307,642 | 3/1967 | Smith | 175/4.51 |
| 3,776,323 | 12/1973 | Spidell et al. | 175/4.51 |
| 3,964,553 | 6/1976 | Basham et al. | 175/4.51 |
| 4,523,649 | 6/1985 | Stout | 175/4.51 |
| 4,637,478 | 1/1987 | George | 175/4.51 |
| 4,693,317 | 9/1987 | Edwards et al. | 175/4.52 X |
| 4,830,120 | 5/1989 | Stout | 175/4.51 |
| 4,898,244 | 2/1990 | Schneider et al. | 166/297 |
| 5,010,964 | 4/1991 | Cornette | 175/4.51 |
| 5,033,553 | 7/1991 | Miszewski et al. | 175/4.51 |
| 5,083,623 | 1/1992 | Barrington | 166/55.1 X |

*Primary Examiner*—Stephen J. Novosad

*Attorney, Agent, or Firm*—Robert A. Kent; Shawn K. Hunter

[57] ABSTRACT

An improved method and apparatus are provided for orienting a particular well completion in accordance with azimuths determined with respect to magnetic north. The invention permits the perforating gun of a wireline tool to be properly oriented in either a vertical or non-vertical wellbore. A wireline tool is described whose lower section contains a gun section and is rotatably joined to the upper section and may be rotated about a swivel joint assembly to move independently of the upper section and in accordance with an orienting means. The rotation may be accomplished by mechanical, hydraulic or electrical means of imparting rotation. In addition, preferred embodiments of the invention include a distant display such that operators may verify directional orientation of charges prior to initiating them. Alternative embodiments are provided for practicing the invention using multiple passes into the well which involve less risk of damage to portions of the well tool.

15 Claims, 2 Drawing Sheets

FIG.3
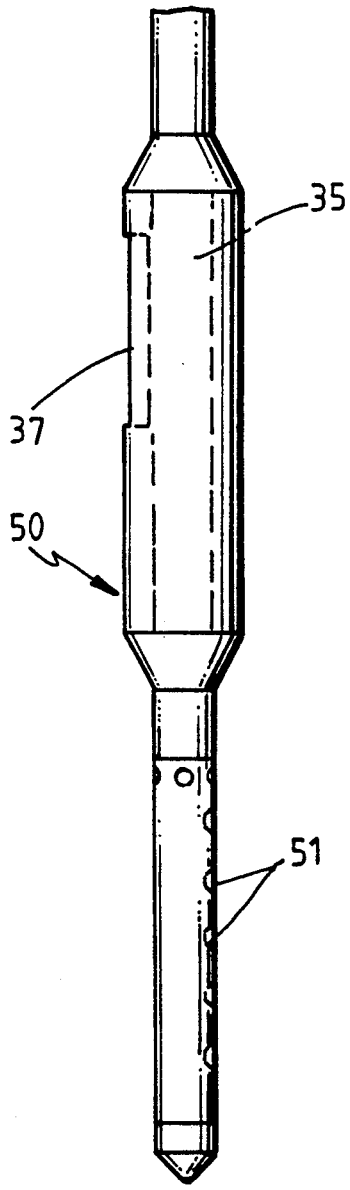
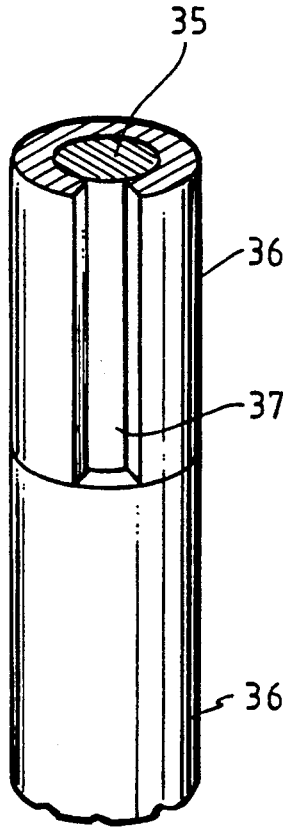
FIG.4

METHOD AND APPARATUS FOR ORIENTING A PERFORATING STRING

BACKGROUND OF THE INVENTION

1. Field of the Invention

The invention relates to a method and apparatus for orienting a perforating device in a subterranean well. More particularly, it relates to an improvement for orienting a perforating device during completion so as to take advantage of directional reservoir characteristics.

2. Description of the Prior Art

Methods are known in the art for orienting perforating guns on downhole oil tools. Generally, such methods have sought to orient a perforating gun in a slanted or offset borehole to prevent clogging of the wellbore from perforations shot vertically upward through the casing. Two such methods are disclosed in U.S. Pat. No. 4,830,120 ("'120 patent"), issued to Stout and U.S. Pat. No. 4,637,478 ("'478 patent"), issued to George.

The '120 patent describes a method and apparatus for firing perforating charges of a gun when they have been oriented in the desired direction. The gun can be rotated by various techniques. If the gun is positioned in the well under a set packer, an explosive charge in the upper portion of the gun firing head and above a swivel may force a piston down a spiral path. The perforating charges and interconnected lower portion of the firing head are rotationally responsive to rotation of the piston, and are thus forced to rotate. A mercury switch responsive to rotation of the perforating charges and positioned below the swivel completes the circuit and the perforating charges fire in their pre-selected direction based on their rotational position relative to the mercury switch. If the well is being completed without the use of a packer it is possible to trip the initiating switch and, if the gun has not fired, rotate the tubing from the surface until the mercury switch is in its downward position, thus completing the circuit and firing the gun.

The '478 patent describes a tubing conveyed perforating gun assembly for connection to a tubing string which enables the gun to be run downhole into a slanted borehole and detonated in order to perforate the wall of the borehole in a predominately downward direction. The charges are directed predominantly downward by virtue of a charge carrier whose center of gravity is displaced from the axis of a spaced journal means in the direction of said firing pattern to cause said shape charges to gravitate into a position which orients the charges predominantly downward so that the penetration, when the charges are dedicated, occurs in a downward direction.

U.S. Pat. No. 4,523,649 ("'649 patent"), also issued to Stout, discloses a further method and apparatus for rotational alignment of tubing conveyed perforating guns. The disclosed apparatus contains a swivel unit connecting a perforating gun assembly to the end of a tubular conduit, said swivel unit comprising an angular thrust bearing thereby permitting rotation of the perforating assembly relative to the conduit. An axially extending narrow rib on the exterior of said perforating gun assembly is aligned with and overlays a portion of one row of charge containers. The containers overlayed by said rib are blank, which shifts the center of gravity to cause said perforating gun assembly to gravitationally rotate in any non-vertical section of the well casing to position said rib in engagement with the upper portion of the non-vertical casing section. The rib is angularly positioned relative to all the explosive charge containers so that no explosive charge is directed vertically upward.

The above-described methods, while useful in many situations, do not offer the degree of control needed to take advantage of directional reservoir characteristics, particularly where the wellbore is substantially vertical.

A method such as that described in the '120 patent is even disadvantageous. The '120 patent, for example, provides for the orientation procedure to occur as a part of the procedure for initiating the explosive charges. As a result, operators on the surface are unable to confirm the orientation of the charges at a particular azimuth prior to the charges being fired.

Methods such as those described in the '478 patent and the '649 patent rely upon gravity to orient the perforating gun charges and, consequently, require a non-vertical section of the well casing to do so. Also, charges are oriented primarily downward rather than in a geographical direction as required to exploit a reservoir's geographic characteristics. Clearly, means are needed to permit drilling crews attempting to develop a formation in a geographically advantageous manner to orient well completions azimuthally, with respect to magnetic north.

SUMMARY OF THE INVENTION

An improved method and apparatus are provided for orienting a particular well completion to take advantage of directional reservoir characteristics. These reservoir characteristics may include directionally oriented stress/strain properties, permeability, prior or secondary porosity, grain size/shape, or sorting characteristics. The invention permits the perforating gun of a wireline tool to be properly oriented in either a vertical or non-vertical wellbore in accordance with an orienting mechanism. A wireline tool is described whose lower section contains a gun section that is rotatably joined to an upper section of the tool. The lower section may be rotated by a rotating assembly about a slip joint to move independently of the upper section. The rotating assembly may comprise a mechanical, hydraulic or electrical means of imparting rotation. In addition, the invention provides for a surface display such that operators on the surface may verify directional orientation of the charges prior to initiating them. Alternative embodiments are provided for practicing the invention using multiple passes into the well which involve less risk of damage to portions of the well tool.

BRIEF DESCRIPTION OF THE DRAWINGS

FIGS. 3–4 illustrate an exemplary directional radiation detector in accordance with the present invention.

DESCRIPTION OF PREFERRED EMBODIMENTS

Figure 1:
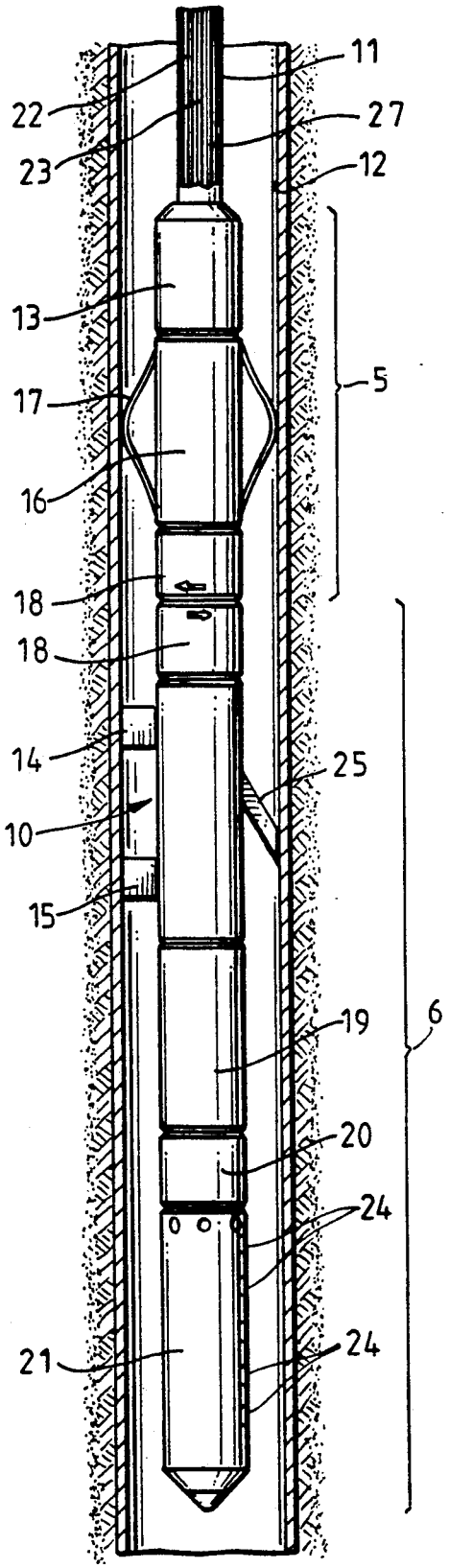
FIG. 1 is a cross-sectional view of a subterranean well within which is suspended exemplary wireline tool 10 of the present invention.

Referring to FIG. 1, wireline tool 10 is suspended by means of logging cable 11 within borehole 12. Wireline tool 10 comprises upper section 5, swivel joint assembly 18, and lower section 6. Upper section 5 comprises a casing collar locator 13, motor control section 16 and centralizer/slip assembly 17. Lower section 6 preferably comprises orientation sub 19, shock absorber 20, and gun section 21. Standoffs 14 and 15 and decentralizer 25 may be included in some embodiments. Logging cable 11 preferably includes a D/C power conduit 22 and A/C power conduit 23. A/C power conduit 23 attaches, by means of a transformer coupling, to charges 24 within gun section 21. Charges 24 preferably comprise shaped charges or similar charges which direct the force of the charge in a particular direction. Charges 24 are placed within a narrow angular pattern within gun section 21.

Orientation sub 19 includes an orientation means sufficient to determine an azimuth with respect to magnetic north. The orientation means may comprise any of a number of gyroscopic/accelerometer devices which are often used as navigation tools. One such suitable device is the Omni DG76® four-gimbal gyro platform available from Humphrey, Inc., 9212 Balboa Ave., San Diego, Calif. 92123, (619) 565-6631. Similar gyroscopic/accelerator technologies may be substituted for the orientation means which include other mechanical rate gyros, ring laser-type gyros, or fiber optics-type gyros.

Azimuthal information may then be provided, via transmission means 27 to a distant display such as surface display through which it may be interpreted by operators. Casing collar locator 13 preferably includes a depth sensor device, of types which are known in the art, which is connected by transmission means 27 to a distant display.

In operation, wireline tool 10 is suspended from logging cable 11 and lowered into borehole 12. Casing collar locator 13 is used to place the tool at an approximated predetermined depth and transmits depth information, via transmission means 27 to a remote surface display. When the desired depth is reached, centralizer/slip assembly 17 is set against the casing of borehole 12 to prevent upper section 5 from rotating with respect to borehole 12. Standoffs 14 and 15 and decentralizer 25 may additionally be set against the casing for added stability.

To accomplish the rotation of lower section 6, motor and control unit 16 is activated. Motor and control unit 16 is associated with D/C power conduit 22 such that operation of the unit is powered with D/C power. Motor and control unit 16 may comprise any of a number of mechanical, hydraulic, or electric devices known in the art for accomplishing such rotation.

Due to the imparted rotation, lower section 6 will rotate about swivel joint 18 with respect to both upper section 5 and borehole 12. Swivel joint assembly 18 preferably includes a pair of rotatably joined cylinders which rotate with respect to each other upon actuation by a motor and control unit or similar power means. The azimuthal orientation of lower section 6 is determined by the orientation means within orientation sub 19, and the orientation information transmitted via transmission means 27 to a distant display.

The distant display may comprise a number of digital and/or analog displays which preferably show a surface operator a combination of downhole readings describing the position and/or orientation of wireline tool 10.

Once the operator has determined from surface display 28 that wireline tool 10 is in the desired position in terms of depth and azimuthal orientation, he may initiate charges 24 of perforating gun 21. Such initiation is accomplished by energizing A/C power conduit 23. Shock absorber 20 helps protect the remaining portions of wireline tool 10 from the shock associated with detonation of charges within perforating gun 21.

Figure 2:
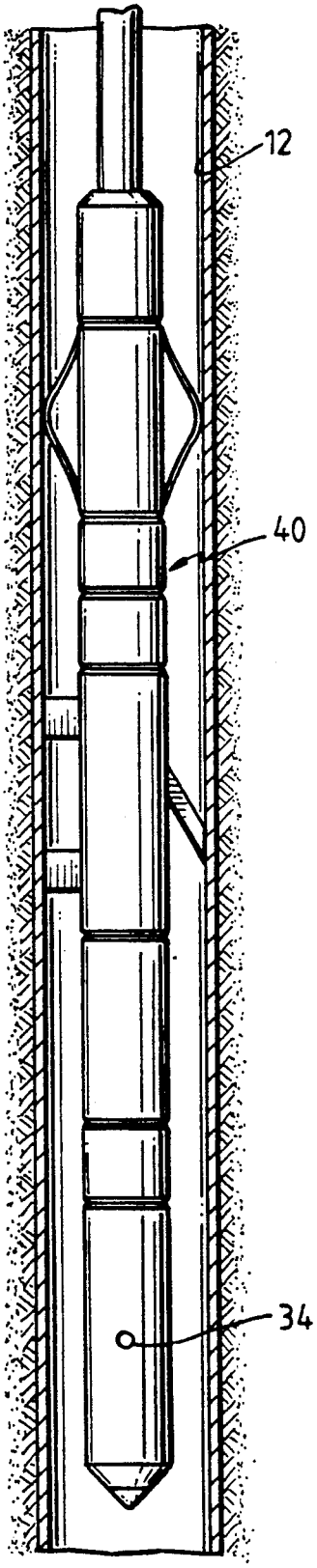
FIG. 2 is a cross-sectional view of a subterranean well within which is suspended exemplary wireline tool 10 of the present invention.

An alternative embodiment of the present invention may be used to provide greater protection to portions of the orientation sub against shock generated by detonation of charges 24. In this embodiment, two passes into the well are required. In the first pass, a wireline tool 40 is suspended within the borehole 12. Exemplary wireline tool 40, seen in FIG. 2, is similar to the previously described wireline tool 10 in most respects. However, gun section 21 is modified in tool 40 such that charges 24 are replaced with tracer gun 34. Tool 40 is lowered to a desired depth in the same manner as was previously described in relation to wireline tool 10. Centralizer/slip assembly 17 and standoffs 14 and 15 are set. Gun section 21 is rotated in the same way as was done with tool 10.

Tracer gun 34 is designed to place a radioactive marker within or upon the borehole wall or casing of borehole 12 upon energizing of A/C power conduit 23. In one highly preferred embodiment, tracer gun 34 comprises a single-shot gun which fires a radio active pellet. In an alternative embodiment, gun 34 comprises a pump/ejector assembly which projects a liquid isotope onto the wall. Once the marker or pellet has been emplaced, tool 40 is removed from borehole 12.

The second pass into the well is accomplished by lowering wireline tool 50 into borehole 12. Wireline tool 50 is also similar to exemplary wireline tool 10 in most respects. However, in tool 50, orientation means 26 within orientation sub 19 is replaced by a directional radiation detector 35, illustrated in FIGS. 3-4, which is suitable for determining the angular orientation of tool 50 with respect to the previously implanted radio active pellet or marker. Detector 35 may also be connected by transmission means 27 to a distant display. As may best be seen in FIG. 4, exemplary detector 35 comprises a device capable of receiving and detecting the presence of gamma radiation as is generally known in the art. The housing surrounding detector 35 is preferably shielded against passage of gamma radiation over portions of its surface by shielding 36. Detector 35 may be located proximate the central axis of orientation sub 19. Selective exposure of detector 36 to gamma radiation is permitted by a narrow angular slot or window 37 along the longitudinal axis of tool 50. FIG. 3 illustrates a preferred placement for detector 35 wherein slot or window 37 is located along the opposite side of tool 50 from the direction of firing for perforating charges 51, to provide enhanced protection of the detector from the charges.

The portion of tool 50 containing detector 35 should be rotated in a manner similar to that described above for portions of tool 10. Since detector 35 obtains only selective detection of radiation through window 37, the amount of radiation detected from the preplaced radioactive marker will be greater when window 37 is approximately facing the marker. When detector 35 and window 37 are rotated, the angular direction of the preplaced radioactive marker within borehole 12 may be determined from the intensity of radiation detected at different angular positions. Preferably, the detector portion of tool 50 should be rotated a number of times slowly to ensure that an accurate determination has been made of the position of the marker.

As described previously, tool 50 is lowered to a predetermined depth within borehole 12 and a centralizer set. This depth should be proximate the location at which the radioactive marker was previously placed. The lower section of tool 50 is then angularly adjusted with respect to the radioactive marker as determined using the distant display. Since charges 51 are preferably located along the opposite side of tool 50 from window 37, the lower portion of tool 50 will have to be rotated 180° after the location of the radioactive marker has been made. Finally, charges 51 may be initiated to perforated the casing at the desired depth and angular orientation.

It is to be understood that the forms of the invention herein shown and described are to be taken as preferred examples of the same and that various changes or modifications in the shape, size, arrangement of parts, or materials used may be made without departing from the spirit of the invention or the scope of the claims.

What is claimed:

1. A wireline downhole tool for perforating a borehole surface substantially in a predetermined azimuthal direction comprising an upper and lower portions, said lower portion containing a perforating device, said lower portion further rotatably joined to the upper portion capable of rotating independently of said upper portion and orientable in relation to azimuths determined with respect to magnetic north by an orienting means.

2. The tool of claim 1 wherein said orienting means comprises a gyroscopic/accelerometer device.

3. The tool of claim 2 further comprising a distant display for receipt of information for said orientation means indicative of said azimuthal direction of said perforating device.

4. The tool of claim 2 further comprising a swivel joint assembly disposed between said upper and lower portions, said swivel joint assembly actuatable by a motor and control unit installed in one of said upper or lower portions.

5. The tool of claim 4 further comprising a shock absorber installed in said lower portion.

6. The tool of claim 1 wherein the orienting device comprises a directional radiation detector.

7. The tool of claim 6 wherein the directional radiation detector is adapted to determine the angular position of a preplaced radioactive marker within a borehole.

8. A method for perforating a borehole surface substantially in a predetermined azimuthal direction comprising the steps of:

a. disposing a wireline tool having a perforating device at a desired depth within a borehole, said perforating device having charges which may be detonated;

b. angularly positioning the perforating device substantially in accordance with a predetermined azimuthal direction; and c. detonating charges within the perforating device.

9. The method of claim 8 wherein the perforating device is angularly positioned substantially in accordance with a predetermined azimuthal direction by determining and adjusting the orientation of the perforating device with respect to magnetic north.

10. The method of claim 8 wherein the perforating device is angularly positioned substantially in accordance with a predetermined azimuthal direction by determining and adjusting the angular orientation of the perforating device with respect to a preplaced marker within the borehole.

11. The method of claim 10 wherein the marker is placed upon the borehole surface by a wireline tool tracer gun.

12. The method of claim 10 wherein the marker is radioactive.

13. The method of claim 12 wherein adjustment of the angular orientation of the perforating device with the preplaced marker is performed upon detection of directional radiation indicative of said marker.

14. The method of claim 13 wherein information indicative of angular orientation of the perforating device with respect to the marker is displayed by a distant display.

15. The method of claim 13 wherein information indicative of azimuthal direction of the perforating device is displayed by a distant display.

* * * * *